US009234345B1

(12) United States Patent
O'Keeffe

(10) Patent No.: US 9,234,345 B1
(45) Date of Patent: Jan. 12, 2016

(54) SNAP-TOGETHER FIRE RESISTANT FENESTRATION FRAME APPARATUS

(71) Applicant: William F. O'Keeffe, Brisbane, CA (US)

(72) Inventor: William F. O'Keeffe, Brisbane, CA (US)

( * ) Notice: Subject to any disclaimer, the term of this patent is extended or adjusted under 35 U.S.C. 154(b) by 0 days.

(21) Appl. No.: 14/692,558

(22) Filed: Apr. 21, 2015

(51) Int. Cl.
*E06B 3/96* (2006.01)
*E04B 1/94* (2006.01)

(52) U.S. Cl.
CPC . *E04B 1/944* (2013.01); *E04B 1/94* (2013.01); *E06B 3/96* (2013.01); *E06B 3/9612* (2013.01); *E06B 3/9616* (2013.01)

(58) Field of Classification Search
CPC ..... E04B 2/88; E04B 2/90; E04B 1/944; E04B 1/94; E06B 3/9616; E06B 3/9612; E06B 3/96; E06B 5/161; E06B 5/165; E06B 3/667; E06B 3/663; E06B 3/66304; E06B 3/66309; Y10T 403/4602; Y10T 403/555; Y10T 403/725
USPC ..... 52/204.5, 204.57, 204.68, 232, 235, 52/463, 464, 656.2, 656.9, 769–774
See application file for complete search history.

(56) References Cited

U.S. PATENT DOCUMENTS

| | | | | |
|---|---|---|---|---|
| 3,389,527 | A * | 6/1968 | Collard | E04B 2/967 52/461 |
| 4,094,112 | A | 6/1978 | Smith et al. | |
| 4,117,640 | A | 10/1978 | Vanderstar | |
| 4,164,830 | A | 8/1979 | Bierlich | |
| 4,281,481 | A | 8/1981 | Wendt | |
| 5,481,839 | A * | 1/1996 | Lang | E04B 2/967 52/235 |
| 5,632,125 | A * | 5/1997 | Osanai | E04B 2/96 52/235 |
| 5,694,731 | A * | 12/1997 | Tonsmann | E06B 3/26303 49/504 |
| 6,141,923 | A | 11/2000 | Habicht et al. | |
| 7,487,591 | B2 * | 2/2009 | Harkins | E06B 5/164 29/897.3 |
| 8,011,146 | B2 | 9/2011 | Krause | |
| 8,484,916 | B2 * | 7/2013 | Farag | E04B 2/90 52/204.5 |
| 2002/0148178 | A1 * | 10/2002 | Farag | E04B 2/96 52/204.1 |
| 2014/0090319 | A1 * | 4/2014 | Swartz | E04B 2/967 52/235 |

FOREIGN PATENT DOCUMENTS

| | | | | |
|---|---|---|---|---|
| DE | 4107933 | A1 * | 9/1992 | E04B 1/94 |

* cited by examiner

*Primary Examiner* — Brian Glessner
*Assistant Examiner* — Adam Barlow
(74) *Attorney, Agent, or Firm* — Theodore J. Bielen, Jr.

(57) ABSTRACT

An apparatus for forming a fenestration including a glazing unit utilizing a base support and a pair of retainers that snap-into place on the base to form a recess for support of the glazing unit.

16 Claims, 4 Drawing Sheets

SNAP-TOGETHER FIRE RESISTANT FENESTRATION FRAME APPARATUS

BACKGROUND OF THE INVENTION

The present invention relates to a novel and useful snap-together fire resistant fenestration frame apparatus.

Buildings of modern construction are often required to include doors and windows that are deemed to be resistant to fire over a specific period of time. The combination of fire rated glass and framing must be matched in order for the full assembly of glazing and framing to meet the requirements of certain codes.

In the past, the most common frame employed in fire resistant assemblies has been the hollow metal frame. Further development in this field have included the use of fire resistant framing with the ability to block the spread of radiant heat.

In the past, fire resistant framing for fenestrations such as windows, doors, skylights, and the like have been proposed. For example, U.S. Pat. Nos. 4,094,112, 4,164,830, 4,281,481, 5,481,839, and 8,011,146 describe door and window frames that include covers and trims that are snapped into place once the frames are assembled.

U.S. Pat. No. 4,428,178 shows a support for glass panels having a series of mullions that include support clips located at intersections of the mullions. The support clips are also found on horizontal supports that are used to support the glass panels.

U.S. Pat. Nos. 3,389,527, 4,117,640 and 6,141,923 describe window frames that include snap-together elements and are intended to provide fire resistance by the provision of spacing upon the release of fire suppressing materials.

U.S. Pat. Nos. 5,694,731 and 7,487,591 shows fire resistant frame assemblies utilizing slabs of water absorbent and intumescent materials to effect heat and fire protection.

A snap-together fire resistant fenestration frame apparatus for use with fire resistant glazing would be a notable advance in the field of fire protection components used in edifices.

SUMMARY OF THE INVENTION

In accordance with the present invention a novel and useful snap-together fire resistant fenestration frame apparatus is hereafter provided.

The apparatus of the present invention utilizes a base support that includes an elongated member. The elongated member, which may be in the form of an elongated tube, provides a first wall and a second wall that lie apart from one another. A spacer may be employed to fix the first and second walls in this position and may be inherent in the construction of base support having the form of an elongated tube.

First and second hollow retainers are positioned adjacent the first and second walls, respectively. Each of the retainers are formed with a chamber that maybe employed to contain combustion resistant filling such as a concrete-like material, a mortar material, a fibrous material, and the like.

A pair of resilient clips are mounted to the first and second walls of the elongated member of the base support. The resilient clips are employed to hold and engage the first and second hollow members, respectively to the base support. In this regard, each of the hollow retainers may be formed with an outer perimeter forming a channel having a surface that is capable of frictionally contacting and locking each of the resilient clips extending from first and second walls of the elongated member of the base support. Thus, the first and second hollow retainers mount to the base support in a "snap-on" fashion via the pair of resilient clips. Once in place relative to the base support, the first and second retainers form one or more recesses to hold one or more glazing elements as part of the window assembly.

It may be apparent that a novel and useful snap-together fire resistant fenestration frame has been hereinabove described.

It is therefore an object of the present application to provide a snap-together fire resistant fenestration frame apparatus that is easy to install and accommodates fire rated glass.

Another object of the present invention is to provide a snap-together fire resistant fenestration frame apparatus that is simple to manufacture and is reliable in a variety of applications.

A further object of the present invention is to provide a snap-together fire resistant fenestration frame apparatus that meets the requirements of standard fire rating tests.

Another object of the present invention is to provide a snap-together fire resistant fenestration frame apparatus that possesses construction integrity.

Another object of the present invention is to provide a snap-together fire resistant fenestration frame apparatus that reduces labor and expenses in assembly and installation in the construction, alteration, or repair of a building.

The invention possesses other objects and advantages especially as concerns particular characteristics and features thereof which will become apparent as the specification continues.

Figure 1:
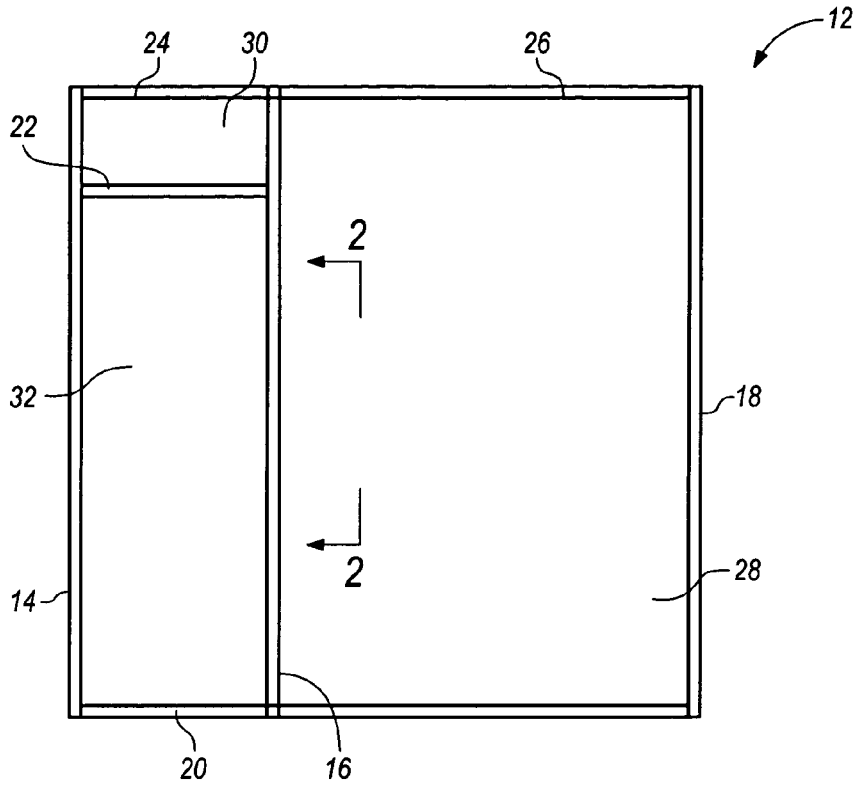
FIG. 1 is a front elevational view of a fenestration assembly using the frame structure of the present invention.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present fenestration frame apparatus will evolve from the following detailed description of the preferred embodiments thereof which should be referenced to the prior described drawings.

The frame apparatus 10 is denoted by upper case letter to distinguish embodiments of the same. Apparatus 10A is used to construct a fenestration assembly 12 shown in FIG. 1. Assembly 12 includes vertical members 14, 16, and 18 and horizontal members or mullions 20, 22, 24, and 26. The result of such assemblage creates window panels or glazing units 28, 30, and 32. The fenestration frame apparatus 10A of the present invention is shown by exemplar vertical member or mullion 16, further detailed in FIGS. 2 and 3. Although a variety of glazing units maybe employed in fenestration assembly 12, figures of the present application depict the glazing material as a SuperLight III-XL-120 manufactured and distributed by O'Keeffe's, Inc, doing business as Safety-First, of Brisbane, Calif. Window unit 28 having glazing section 29, thus, includes a plurality of glass sheets 32 separated by fire retardant fillers 34.

Figure 2:
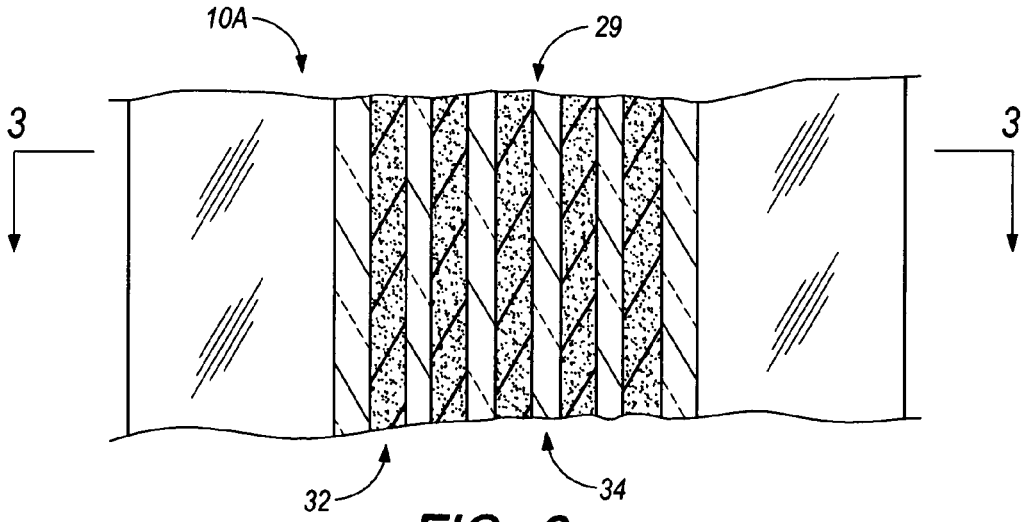
FIG. 2 is a sectional view taken along line 2-2 of FIG. 1.
Figure 3:
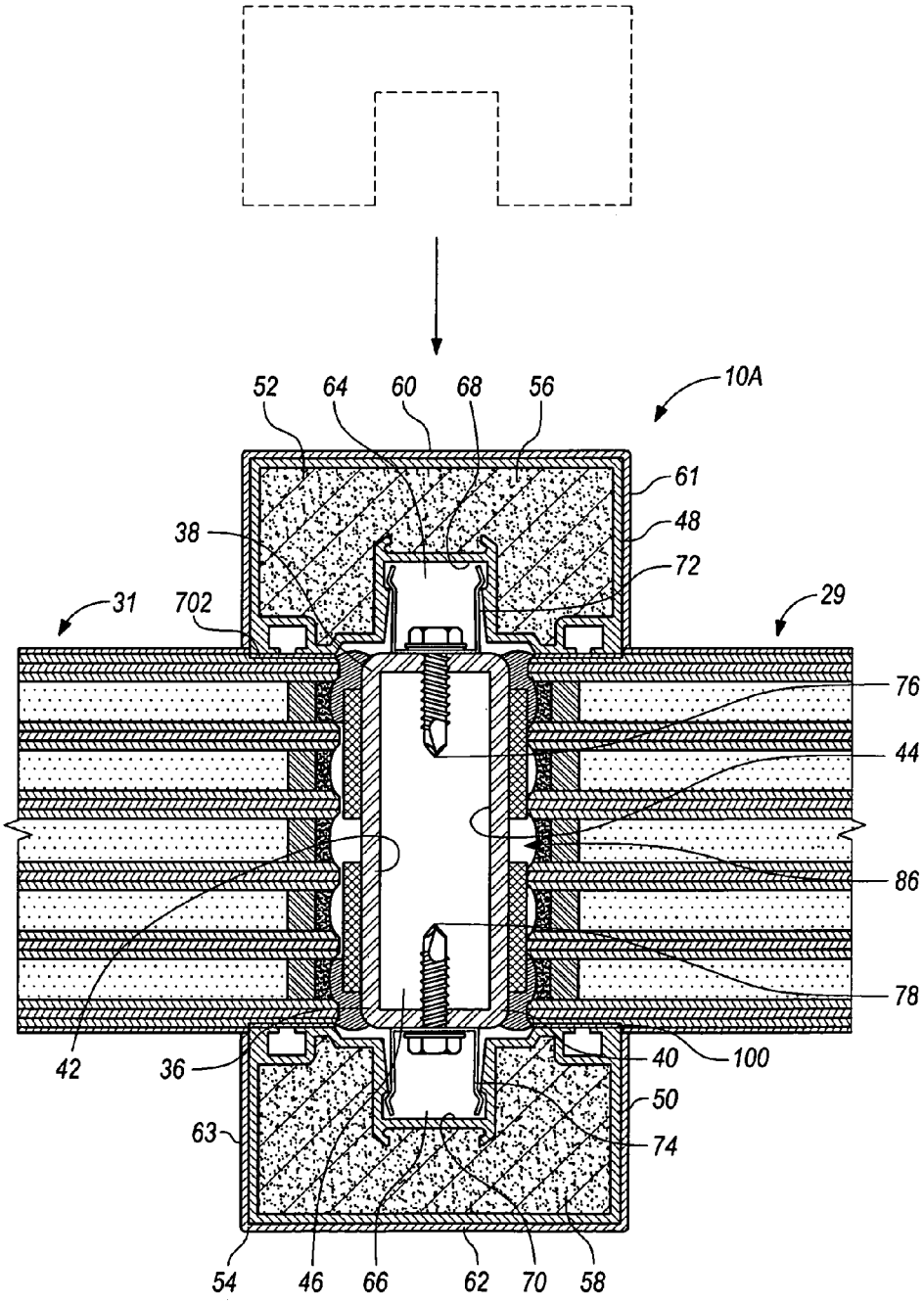
FIG. 3 is a sectional view taken along line 3-3 of FIG. 2.

With reference to FIG. 3, it may be observed that apparatus 10A includes a base support 36 which may be in the form of rectangular steel tube. Tube 36 is provided with a first wall 38 and a second wall 40, separated by walls 42 and 44. Consequently, walls 42 and 44 serve as spacers between first wall 38 and second wall 40. As shown in FIG. 1, base support 36 would extend the length vertical member 16 of fenestration assembly 12. In addition, base support 36 includes an open interior space 46.

Apparatus 10A is further constructed with a first hollow retainer 48 and a second hollow retainer 50. Retainers 48 and 50 may also be referred to as pressure bars or extruded channels. Retainers 48 and 50 extend along base member 36 and are formed with chambers 52 and 54, respectively. Chambers 52 and 54 hold masses of combustion resistant material, such as a composite-like material, mortar, and the like. Covers 60 and 62 frictionally engage the outer surface retainers 48 and 50. Covers 60 and 62 may be formed of any rigid or semi-rigid material such as aluminum, and the like. Retainers 48 and 50 are further provided with channels 64 and 66, respectively. Channels 64 and 66 include inner friction surfaces 68 and 70, the purpose of which will be discussed as the specification continues.

Figure 4:
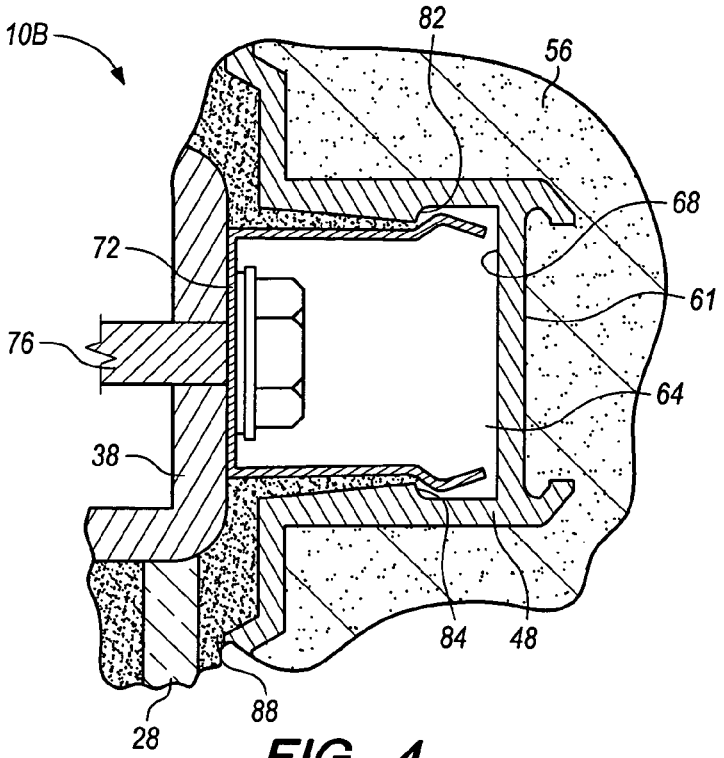
FIG. 4 is an enlarged sectional view of the clip of the present invention engaging a recess of a retainer element of the fenestration frame apparatus of the present invention
Figure 5:
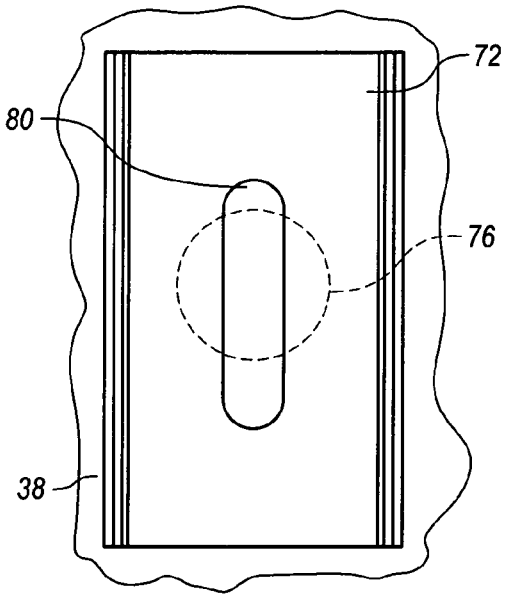
FIG. 5 is a front elevational view of the clip used in the apparatus of the present application, shown in FIG. 4.

Apparatus 10A may also be fashioned with resilient clips 72 and 74, associated with first and second hollow retainers 48 and 50, respectively. Fasteners 76 and 78, in the form of hex-head tek screws, mount resilient clips 72 and 74 to first wall 38 and second wall 40 of base member 36, respectively. Fasteners 76 and 78 extend into inner space 46 of base member 36, in this regard. Resilient clips 72 and 74 extend into channels 64 and 66 of hollow retainers 48 and 50, respectively. As may be observed in FIG. 5, exemplar clip 72 includes a slot 80 to accommodate fasteners 76. In addition, FIG. 4 shows exemplar clip 72 engaging outer perimeter 61 friction surface 68 of hollow retainer 48, specifically at notches 82 and 84. Thus, once clip 72 and clip 74 are fastened to walls 38 and 40, respectively, retainers 48 and 50 may be snapped into place by the application of force thereupon relative to base member 36. When assembled, apparatus 10A forms recesses 100 and 102 for glazing sections 29 and 31, which may be mounted by friction engagement or by fasteners (not shown).

Other materials such as intumescent tape portions 86, embodiment 10A of FIG. 3, and structural glaze sealant or caulk 88 in embodiment 10B of FIG. 4 may be employed as fillers or fire barriers within apparatus 10.

It has been found that apparatus 10B exhibits notable fire resistance and the following example which is illustrative of the same.

EXAMPLE

The fenestration assembly 12 of FIG. 1, including the frame apparatus 10B of FIG. 4 in place of apparatus 10A, was utilized as a test assembly in a fire endurance test. Panels 30 and 32 were tested separately from panel 28. The fire endurance test was conducted in accordance with the standard, Fire Test of Building Construction and Materials, ANSI/UL263 (ASTM E119), $14^{TH}$ addition, dated Jun. 21, 2011. Following termination of the fire endurance test, assembly 12 was subjected to a hose stream test in accordance 5.4 of ANSI/UL263. Again panels 30 and 32 were tested separately, in the hose stream test, from panel 28.

The ambient temperature of the start of the fire test was 69 degrees Fahrenheit for panels 30 and 32 and 68 degrees Fahrenheit for panel 28. Testing occurred during a 60 minute period for panels 30 and 32 as well as for panel 28.

Figure 6:
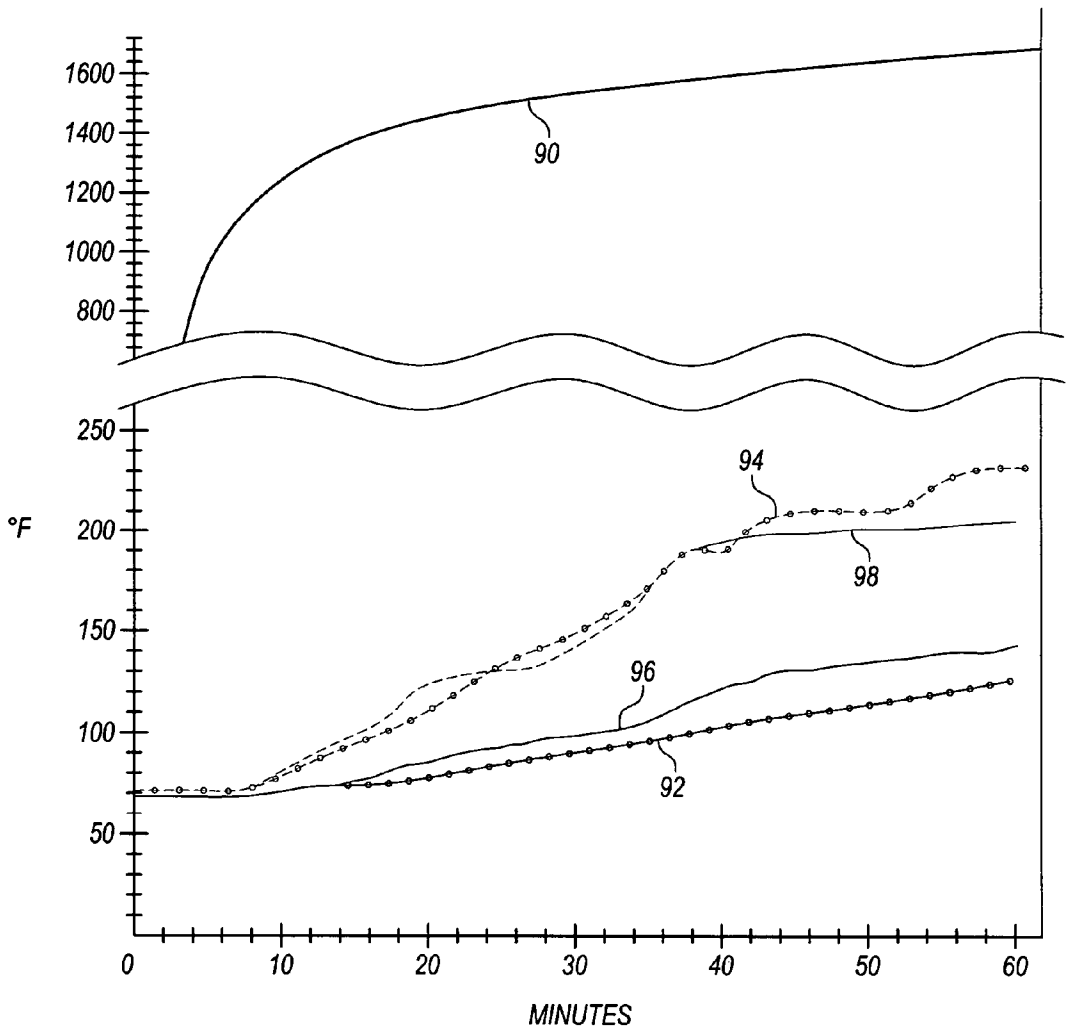
FIG. 6 is a graph indicating the temperature of a heat source compared to the temperature of a fenestration assembly utilizing the present invention, over a common time period, during a fire endurance test.

FIG. 6 represents the conducting and results of such fire endurance test. Graph line 90 shows the temperature of the heat source or furnace applied to one side fenestration assembly 12. Over a sixty minute period, the temperature of such furnace approached 1600 degrees Fahrenheit. A plurality of thermal-couples were placed about assembly 12, on the side opposite to the furnace, to record temperature passage through assembly 12. Graph lines 92 and 94 represent the average and maximum temperatures over 60 minutes, respectively, of the unexposed panel 28. Likewise, graph lines 96 and 98 represent the average and maximum temperatures over 60 minutes, respectively, for the unexposed surfaces of panels 30 and 32.

The following the heat exposure test heretofore described, a hose stream test was instituted. No passage of water was observed through panels 30, 32, or 28.

It was concluded that assembly 12, using apparatus 10B, would be judged eligible to bear a UL mark.

In operation, the user assembles apparatus 10A or 10B by snapping on retainers 48 and 50 to base member 38 such that resilient clips 72 and 74 fictionally engages surfaces 68 and 70 within channels 64 and 66 of retainers 48 an 50, respectively. Glazing sections 29 and 31 are then sandwiched between retainers 48 and 50 within recesses 100 and 102, respectively, formed by the connecting of retainers 48 and 50 relative to base member 38. It should be realized, however, that only a single glazing section, such as glazing unit 29, may be employed in the present invention. Once apparatus 10A or 10B is assembled, such apparatus may be employed in a fenestration assembly, such as fenestration assembly 12 depicted in FIG. 1.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A snap-together fire resistant fenestration frame apparatus employed with a glazing, comprising:

a. a base support, said base support including an elongated member, said elongated member including a first wall and a second wall said first wall lying apart from said second wall;

b. a spacer, said spacer fixing said first wall apart from said second wall of said elongated member;

c. a first hollow retainer positioned adjacent said first wall, said first hollow retainer including an enclosed chamber;

d. a second hollow retainer positioned adjacent said second wall, said second hollow retainer including an enclosed chamber;

e. a first resilient clip mounted to said first wall of said elongated member of said base support, said first resilient clip engaging and holding said first hollow retainer to said base support;

f. a second resilient clip mounted to said second wall of said elongated member of said base support, said second resilient clip engaging and holding said second hollow retainer to said base support; said first and second hollow retainers held to said base support providing a recess for mounting the glazing.

2. The apparatus of claim 1 in which further comprises a cover positioned over at least said first hollow retainer.

3. The apparatus of claim 1 in which said first hollow retainer includes an outer perimeter, said outer perimeter of said first hollow retainer forming a channel, said channel including a surface for frictionally contacting said first resilient clip for engaging and holding said first hollow retainer to said base support.

4. The apparatus of claim 3 in which said second hollow retainer includes an outer perimeter, said outer perimeter of said second hollow retainer forming a channel, said channel including a surface for frictionally contacting said second resilient clip for engaging and holding said second hollow retainer to said base support.

5. The apparatus of claim 1 which further comprises a first fastener for mounting said first resilient clip to said first wall of said elongated member of said base support.

6. The apparatus of claim 5 which further comprises a second fastener for mounting said second resilient clip to said second wall of said elongated member of said base support.

7. The apparatus of claim 1 which further comprises a mass of combustion resistant material located in said chamber of said first hollow retainer.

8. The apparatus of claim 7 in which said mass of combustion resistant material comprises a first mass of combustion resistant material and which further comprises a second mass of combustion resistant material located in said chamber of said second hollow retainer.

9. The apparatus of claim 1 in which said base support comprises an elongated tube.

10. The apparatus of claim 9 in which further comprises a cover positioned over at least said hollow retainer.

11. The apparatus of claim 9 in which said first hollow retainer includes an outer perimeter, said outer perimeter of said first hollow retainer forming a channel, said channel including a surface for frictionally contacting said first resilient clip for engaging and holding said first hollow retainer to said base support.

12. The apparatus of claim 11 in which said second hollow retainer includes an outer perimeter, said outer perimeter of said second hollow retainer forming a channel, said channel including a surface for frictionally contacting said second resilient clip for engaging and holding said second hollow retainer to said base support.

13. The apparatus of claim 9 which further comprises a first fastener for mounting said first resilient clip to said first wall of said elongated member of said base support.

14. The apparatus of claim 13 which further comprises a second fastener for mounting said second resilient clip to said second wall of said elongated member of said base support.

15. The apparatus of claim 9 which further comprises a mass of combustion resistant material located in said chamber of said first hollow retainer.

16. The apparatus of claim 15 in which said mass of combustion resistant material comprises a first mass of combustion resistant material and which further comprises a second mass of combustion resistant material located in said chamber of said second hollow retainer.

* * * * *